US005127301A

United States Patent [19]

Suzuki et al.

[11] Patent Number: 5,127,301

[45] Date of Patent: Jul. 7, 1992

[54] WEAR FOR CONTROLLING A MUSICAL TONE

[75] Inventors: Hideo Suzuki; Mamoru Kimpara; Masao Sakama; Akira Nakada, all of Hamamatsu, Japan

[73] Assignee: Yamaha Corporation, Hamamatsu, Japan

[21] Appl. No.: 512,562

[22] Filed: Apr. 23, 1990

Related U.S. Application Data

[63] Continuation of Ser. No. 151,370, Feb. 2, 1988, abandoned.

[30] Foreign Application Priority Data

Feb. 3, 1987 [JP] Japan ..... 62-23382
Feb. 27, 1987 [JP] Japan ..... 62-44231
Feb. 27, 1987 [JP] Japan ..... 62-44232

[51] Int. Cl.[5] ..... G10H 1/06; G10H 1/32; G10H 1/46

[52] U.S. Cl. ..... 84/600; 84/659; 84/665; 84/670

[58] Field of Search ..... 84/600, 622-625, 84/633, 644, 659-661, 665, 670, 692-700, 711, 718, 735, 736, 741, 743; 128/774, 782; 446/175, 26-28, 397, 404; 338/69, 114, 176, 6, 209, 333, 334; 273/DIG. 19, 183 B, 26 C; 73/865.4; 901/9, 32-34, 46; 414/1, 4, 5

[56] References Cited

U.S. PATENT DOCUMENTS 787,089 4/1905 Fahrney ..... 338/114 X
2,853,764 9/1958 De Michele ..... 338/6 X
3,704,339 11/1972 Niinoni ..... 84/1.24
3,820,529 6/1974 Gause et al. ..... 338/114 X
4,444,205 4/1984 Jackson ..... 128/782
4,461,085 7/1984 Dewar et al. ..... 128/782 X
4,580,569 4/1986 Petrofsky ..... 128/420 A
4,608,998 9/1986 Murdock ..... 128/782
4,627,324 12/1986 Zwosta ..... 84/1.01
4,635,516 1/1987 Giannini .
4,649,933 3/1987 Jackson ..... 128/774
4,667,685 5/1987 Fine ..... 128/782
4,715,235 12/1987 Fukui et al. ..... 128/782 X
4,766,389 8/1988 Rhoades et al. ..... 414/5 X
4,776,253 10/1988 Downes .
4,860,364 8/1989 Giannini .
4,905,560 3/1990 Suzuki et al. .

FOREIGN PATENT DOCUMENTS 2750024 5/1979 Fed. Rep. of Germany ..... 338/333
231711 11/1968 U.S.S.R. ..... 128/782
302103 6/1971 U.S.S.R. ..... 128/782
324661 11/1972 U.S.S.R. ..... 338/209

*Primary Examiner*—Stanley J. Witkowski
*Attorney, Agent, or Firm*—Graham & James

[57] ABSTRACT

The wear for controlling a musical tone consists of a wear worn by a player, a main body and at least one detector for detecting a certain movement of the player. The main body is mounted at a player's waist, and the detector is mounted at a player's joint by use of a mounting member such as a plane fastener. Hence, the mounting position of the detector can be freely adjusted. The main body and the detector are connected by use of wires which may be sewed in the wear. In addition, the detector may constitute a supporter which can be freely mounted at the player's joint. When the detector detects the movement of the player, such as a bending angle of the player's joint, a tone pitch, a tone volume or a tone color of the musical tone to be generated is controlled based on the detected movement of the player.

21 Claims, 12 Drawing Sheets

WEAR FOR CONTROLLING A MUSICAL TONE

This is a continuation of copending application Ser. No. 151,370 filed on Feb. 2, 1988 and now abandoned.

BACKGROUND OF THE INVENTION

The present invention generally relates to a wear, and now abandoned more particularly to a wear for controlling a musical tone which detects a movement of a player so as to control a musical tone based on the detected movement of the player.

Conventionally, a musical tone is generated by playing a musical instrument such as a piano, a violin and the like or by use of a vocal cord of the player. In addition, the known musical tone generating apparatus cannot convert a body action of the player into the corresponding musical tone.

Therefore, the present applicant proposed a musical tone control apparatus which converts the body action of the player into the musical tone, in U.S. patent application Ser. No. 108,205 and European Patent Application No. 87114944.9, for example.

Next, description will be given with respect to an example of the proposed musical tone control apparatus in conjunction with FIGS. 1A to 4.

FIG. 1A is a front view showing an appearance of the proposed musical tone control apparatus which is mounted to the player, and FIG. 1B is a back view thereof. This proposed musical tone control apparatus consists of a main body 1 and four detectors such as a detector 2 for a player's left elbow, a detector 3 for a player's right elbow, a detector 4 for a player's left shoulder and a detector 5 for a player's right shoulder. The main body 1 is mounted to a player's waist by a belt B, and the detectors 2 to 5 are respectively mounted to the player's left elbow, the player's right elbow, the player's left shoulder and the player's right shoulder.

Next, detailed description will be given with respect to the above-mentioned detectors 2 to 5. First, the detector 2 is constructed as shown in FIG. 2. In FIG. 2, a lever 8*a* is fixed at a shaft 7*a* of a potentiometer 6*a*, and this lever 8*a* is arranged so that this lever 8*a* can be freely put in and out of an inside of a cylinder 9*a* as shown in FIG. 3. In the inside of the cylinder 9*a*, a spring 10*a* is provided in order to pull the lever 8*a* therein. In addition, a fixing portion 11*a* is formed at an edge of the cylinder 9*a*, and this fixing portion 11*a* is fixed at a center of the player's arm.

When the player bends and stretches his left elbow, the lever 8*a* and the cylinder 9*a* is moved in response to such bending and stretching movement of the player's left elbow so that the shaft 7*a* is revolved. Hence, the resistance of the potentiometer 6*a* must be varied in accordance with a revolving angle of the shaft 7*a*, i.e., a bending angle of the player's left elbow. Such resistance variation of the potentiometer 6*a* is passed through a cable 12*a* and then transmitted to the main body 1 (shown in FIG. 1A), wherein a tone pitch of the musical tone to be generated is controlled based on such resistance variation of the potentiometer 6*a*, for example. Similar to this detector 2, the detector 3 is constructed and operated. More specifically, the resistance variation of a potentiometer 6*b* provided within the detector 3 is passed through a cable 12*b* and then transmitted to the main body 1, wherein the tone pitch of the musical tone to be generated is controlled based on such resistance variation of the potentiometer 6*b*.

Next, the detector 4 is constructed as shown in FIG. 4. In FIG. 4, when the player moves his left shoulder up and down, the resistance of the potentiometer 6*c* must be varied in response to the movement of the player's left shoulder. Such resistance variation of the potentiometer 6*c* is passed through a cable 12*c* and then transmitted to the main body 1, wherein a tone volume of the musical tone is controlled based on such resistance variation of the potentiometer 6*c*. On the other hand, the detector 5 is constructed as similar to the above-mentioned detector 4. A resistance variation of a potentiometer 6*d* provided within the detector 5 is passed through a cable 12*d* and then transmitted to the main body 1, wherein a tone color of the musical tone is controlled based on such resistance variation of the potentiometer 6*d*.

In the proposed musical tone control apparatus described heretofore, the following problems must be inevitably occurred since the four detectors 2 to 5 are mounted to clothes of the player by sewing the detectors 2 to 5 on such clothes. First, it is burdensome for the player to mount such detectors. Secondly, once such detectors are mounted on the clothes of the player, it is not easy for the player to adjust mounting positions of such detectors.

In addition, the proposed musical tone control apparatus suffers the following problem since the main body 1 and the detectors 2 to 5 are connected by slackened cables 11*a* to 11*d*. More specifically, the player's body must be entwined with the cables, or the cables must be caught in equipments and the like surrounding the player, for example. Hence, it is not easy for the player to properly handle the cables. In addition, imperfect contacts between the main body 1 and the detectors 2 to 5 must be occurred frequently. Further, the cables may be broken when the cables are caught in the equipments surrounding the player, for example.

SUMMARY OF THE INVENTION

It is accordingly a primary object of the invention to provide a wear for controlling a musical tone in which it is easy to mount the detectors to the player and it is also easy for the player to adjust the mounting positions of the detectors.

It is another object of the invention to provide a wear for controlling a musical tone which can prevent the imperfect contacts between the main body and the detectors from being occurred and which can also prevent the cables from being broken when the cables are caught in the equipments surrounding the player.

In a first aspect of the invention, there is provided a wear for controlling a musical tone comprising: (a) a wear worn by a player; (b) at least one mounting member mounted at a certain position of the wear, the certain position being set near a player's joint; and (c) movement detecting means for detecting a movement of the player's joint, the movement detecting means being fixed at a desirable position of the wear by the mounting member, whereby the musical tone is controlled based on the detected movement of the player.

In a second aspect of the invention, there is provided a wear for controlling a musical tone comprising: (a) a wear worn by a player; (b) movement detecting means for detecting a movement of the player, the musical tone being controlled based on the detected movement of the player; (c) a first terminal connected with an output wire of the movement detecting means, the movement detecting means providing the first terminal being freely mounted at a desirable position of the wear; (d) a second terminal mounted at a certain position of the wear; and (e) a wire connected between the first and second terminals, the wire being sewed into the wear, whereby the wire is prevented from being broken or imperfect contact between the first and second terminals is prevented from being occurred when the player moves.

In a third aspect of the invention, there is provided a wear for controlling a musical tone comprising: (a) movement detecting means for detecting a movement of a player, the movement detecting means consisting of fibers the resistance of which is varied in response to bending and stretching movement thereof, the movement detecting means being mounted at a player's joint, whereby the resistance thereof is varied in response to a bending angle of the player's joint; and (b) control means for detecting a resistance variation of the movement detecting means, the control means controlling the musical tone based on the detected resistance variation of the movement detecting means, whereby the musical tone is controlled based on the detected bending angle of the player.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

[A] First Embodiment

Next, description will be given with respect to a wear for controlling a musical tone according to a first embodiment of the present invention in conjunction with FIGS. 5A to 8B. In FIGS. 5A to 8B, parts identical to those shown in FIGS. 1A to 4 will be designated by the same numerals, hence, description thereof will be skipped.

Figure 5A:
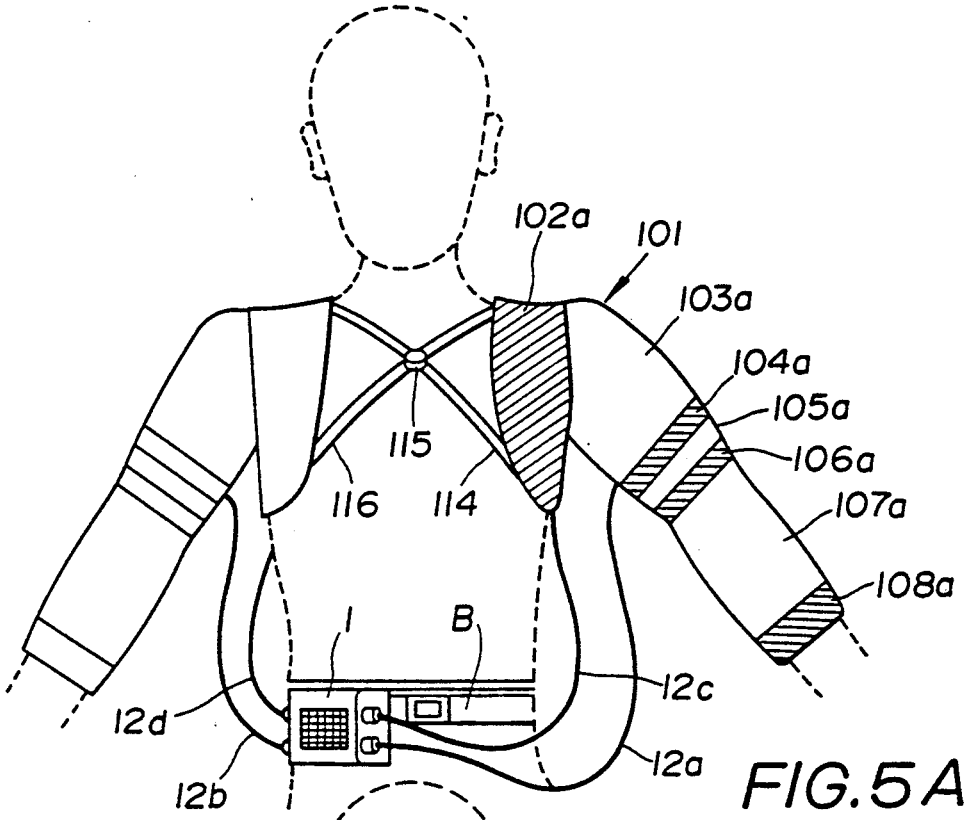
FIGS. 5A and 5B are front and back views both showing a wear for controlling a musical tone according to a first embodiment of the present invention.
Figure 5B:
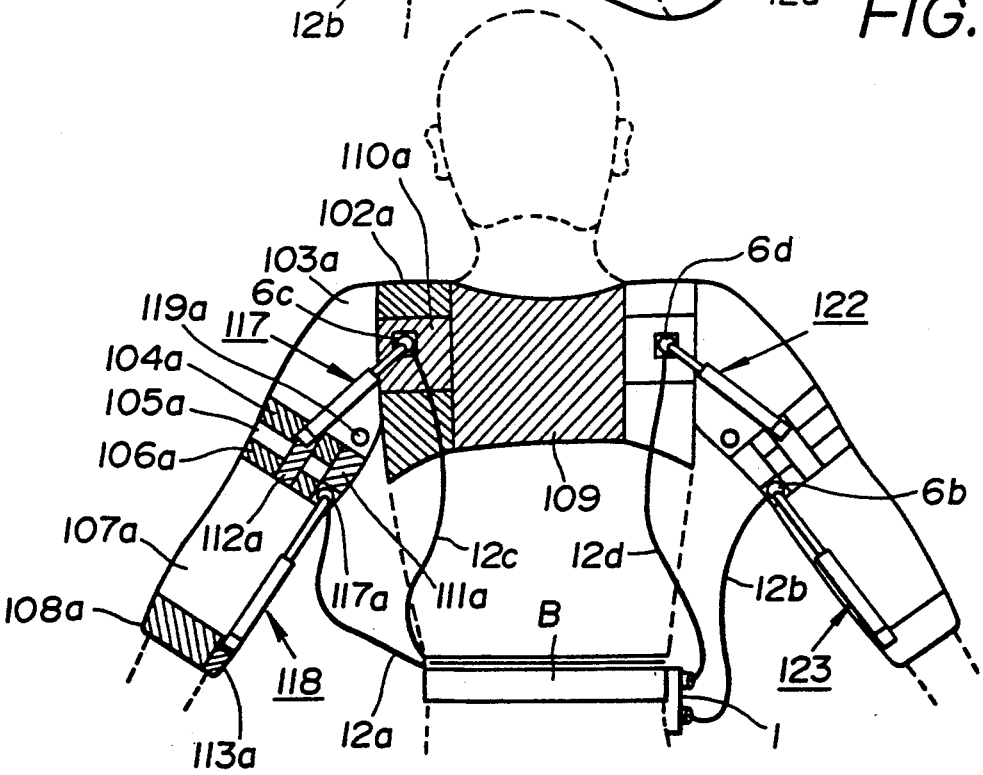

FIG. 5A is a front view showing an appearance of a first embodiment of a wear for controlling a musical tone which is mounted to the player, and FIG. 5B is a back view thereof. In FIGS. 5A and 5B, 101 designates a wear having a symmetrical construction which covers the player from his shoulders to his wrists. In this wear 101, 102*a* designates a supporter made of elastic fibers which covers from the player's left shoulder to a player's left shoulder blade. In addition, the edge of this supporter 102*a* is sewed with one edge of a thin cloth 103*a*. This thin cloth 103*a* stretches between a player's left shoulder joint and a middle position of a player's left elbow joint. Between another edge of the thin cloth 103*a* and the player's left elbow joint, a band-shaped supporter 104*a*, a thin cloth 105*a* and a supporter 106*a* are sequentially sewed together. Next, one edge of a thin cloth 107*a* is sewed with an edge of the supporter 106*a*. This thin cloth 107*a* stretches between the player's left elbow joint and a middle position of a player's left wrist joint. Further, another edge of the thin cloth 107*a* is sewed with one edge of a supporter 108*a*, and this supporter 108*a* stretches to a front position of the player's left wrist. The above-mentioned thin cloths 103*a*, 105*a* and 107*a* are similar to cloths used in a wear for aerobics exercise and the like. On the other hand, the above-mentioned supporters 102*a*, 104*a*, 106*a* and 108*a* are made of thick elastic fibers which are woven with rubber yarns. For example, these supporters are made of thick elastic fibers similar to those used at ankle portions of socks.

Similar to the above-mentioned left arm portion of the wear 101, a right arm portion of the wear 101 is constructed. This right arm portion of the wear 101 is sewed with the left arm portion thereof via a thick cloth 109 (which is similar to that used in a training wear).

Next, a square plane fastener 110*a* is mounted to a shoulder blade portion of the supporter 102*a* as shown in FIG. 5B. In addition, a plane fastener 111*a* is mounted on the supporters 104*a* and 106*a* along an inside of the wear 101, i.e., along an inside of a player's left arm. Further, a plane fastener 112*a* is mounted along a backside of the wear 101, i.e., along a backside of the player's left arm. Similarly, a plane fastener 113*a* is mounted to the supporter 108*a* along the inside of the player's left arm. Similar to such left arm portion of the wear 101, several plane fasteners are mounted at respective positions thereof.

In the left side of the wear 101, a V-shaped belt 114 is mounted as shown in FIG. 5A, and a button 115 is sewed at the top of the belt 114. Similarly, in the right side of the wear 101, a V-shaped belt 116 is also mounted. These two belts 114 and 116 are connected together by the button 115, so that the wear 101 is fixed on a player's upper body.

Figure 6:
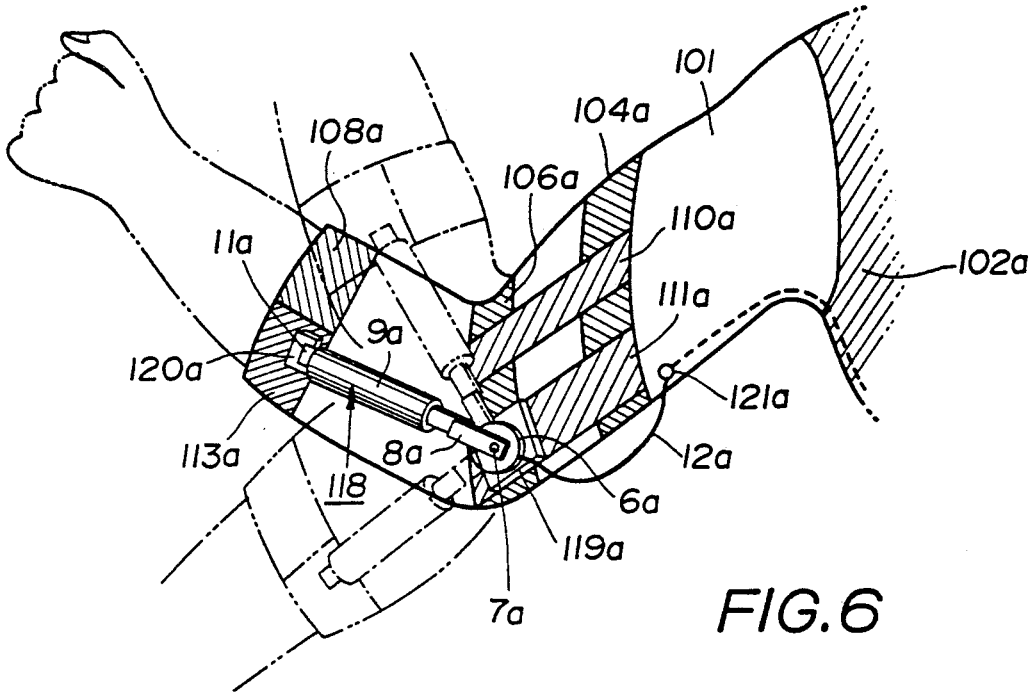
FIG. 6 is a perspective side view showing a detector for the player's left elbow used in the first embodiment.

Next, a detector 117 for the player's left shoulder is mounted between the plane fasteners 110*a* and 112*a*, and a detector 118 for the player's left elbow is mounted between the plane fasteners 111*a* and 113*a*. In this case, the detector 118 is constructed as shown in FIG. 6. In FIG. 6, a plate-shaped plane fastener 119*a* is mounted at a bottom plane of the potentiometer 6*a* of the detector 118, and another plate-shaped plane fastener 120*a* is mounted at the fixing portion 11*a* of the potentiometer 6*a*. Hence, both edges of the detector 118 are respectively mounted to the plane fasteners 111*a* and 113*a* provided on the wear 101 via the plane fasteners 119*a* and 120*a*. Incidentally, the cable 12*a* connected to the potentiometer 6*a* is connected to the main body 1 through a through hole 121*a* which is made at a certain position of the wear 101 near the detector 118. In this case, the through hole 121*a* is made at the certain position on an upper backside of the supporter 104*a* as shown in FIG. 5B.

Similar to the above-mentioned left arm portion of the wear 101, a detector 122 for the player's right shoulder and a detector 123 for the player's right elbow are respectively mounted on the right arm portion of the wear 101 by use of plane fasteners (not shown).

As described heretofore, the plane fasteners are used as the fasteners which mount the detectors 117, 118, 122 and 123 on the wear 101. Hence, it is possible to mount such detectors on the wear 101 with ease, and it is also possible to adjust the mounting position of such detectors with ease.

Figure 7:
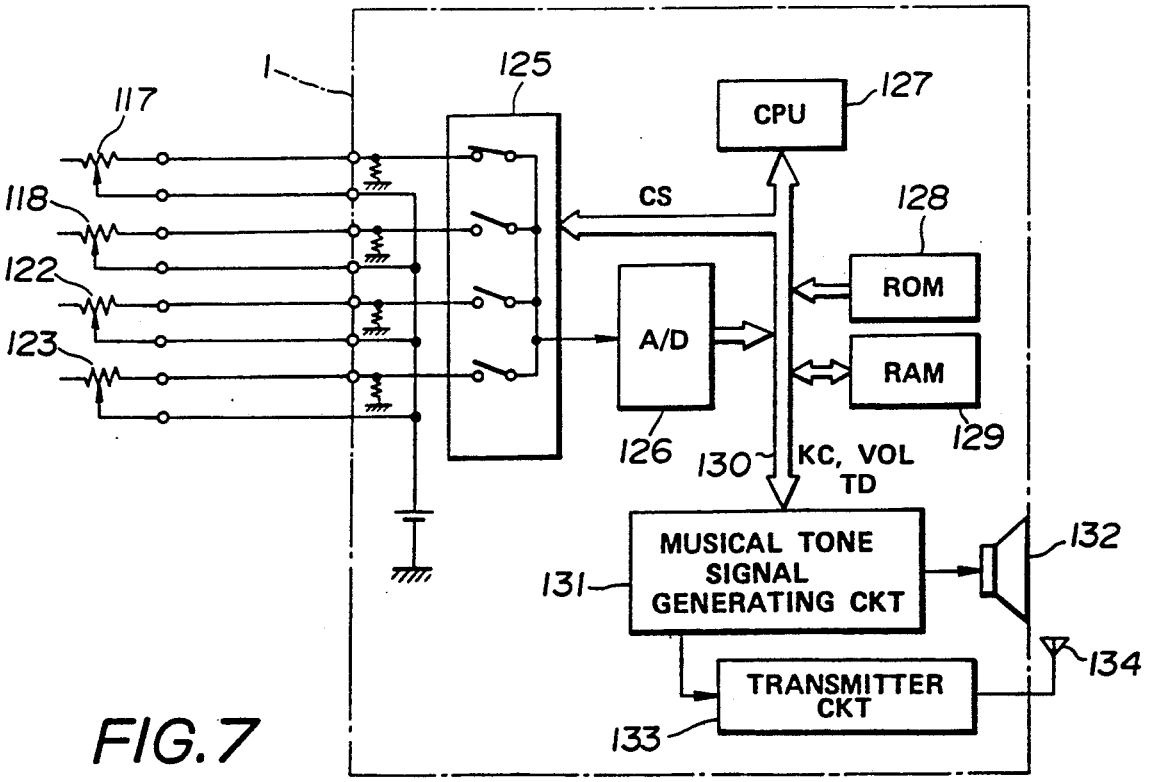
FIG. 7 is a block diagram showing an electric constitution of the first embodiment.

Next, description will be given with respect to an electric constitution of the main body 1 in conjunction with FIG. 7. In FIG. 7, 125 designates a four-channel analog multiplexer which selects and outputs one of the detection signals (i.e., voltage signals) of the detectors 117, 118, 122 and 124 based on a channel select signal CS supplied to a select terminal thereof. Next, an analog-to-digital (A/D) converter 126 converts the detection signal from the analog multiplexer 125 into digital detection data having the predetermined bits. In addition, 127 designates a central processing unit (CPU), 128 designates a read only memory (ROM) for storing programs used in the CPU 127, and 129 designates a random access memory (RAM) used as a working area. The CPU 127 supplies the sequentially varying channel select signal CS to the analog multiplexer 125, so that the outputs of the detectors 117, 118, 122 and 123 are scanned with a high speed.

If the detection signals of the detectors 118 and 123 are selectively converted into the detection data in the A/D converter 126, the CPU 127 discriminates the bending angles of the player's left and right elbows by use of four angle stages based on such detection data. Based on such discrimination result of the CPU 127, the CPU 127 generates a key code data KC designating the predetermined tone pitch in response to a combination of the bending angles of the player's left and right elbows.

On the other hand, if the detection signal of the detector 117 is selectively converted into the detection data, the CPU 127 discriminates the bending angle of the player's left shoulder by use of three angle stages based on such detection data. Based on such discrimination result of the CPU 127, the CPU 127 generates tone volume data VOL selectively designating one of predetermined three tone volumes (i.e., big, middle and small tone volumes) in response to the bending angle of the player's left shoulder.

Further, if the detection signal of the detector 122 is selectively converted into the detection data, the CPU 127 discriminates the bending angle of the player's right shoulder by use of four angle stages based on such detection data. Based on such discrimination result of the CPU 127, the CPU 127 generates tone color data TD selectively designating one of the predetermined tone colors (such as the piano, an organ, a flute, a saxophone, a clarinet and the like) in response to the bending angle of the player's right shoulder.

The CPU 127 generates and outputs musical tone control data such as the key code data KC, the tone volume data VOL and the tone color data TD to a musical tone signal generating circuit 131 via a bus line 130. This musical tone signal generating circuit 131 generates a musical tone signal having a tone pitch corresponding to the key code data KC, a tone volume corresponding to the tone volume data VOL and a tone color corresponding to the tone color data TD. Such musical tone signal is supplied to a speaker 132 wherein a musical tone corresponding to the musical tone signal is to be generated. In addition, a transmitter circuit 133 transmits the musical tone signal by wireless via an antenna 134.

According to the first embodiment as described heretofore, the tone pitch of the musical tone to be generated from the speaker 132 of the main body 1 can be varied in response to the combination of the bending angles of the player's left and right elbow joints. In addition, the tone volume of the musical tone can be varied by three tone volume stages in response to the bending angle of the player's left shoulder joint. Further, the tone color of the musical tone can be varied by four tone color stages in response to the bending angle of the player's right shoulder joint.

In the first embodiment, the plane fasteners are mounted on one position at each of shoulder portions, elbow portions and wrist portions of the wear 101. However, it is possible to mount the plane fasteners so that each of the shoulder portions, the elbow portions and the wrist portions of the wear 101 can be covered by the plane fasteners. In addition, it is also possible to mount the plane fasteners so that whole portion of the wear 101 can be covered by the plane fasteners.

Figure 8A:
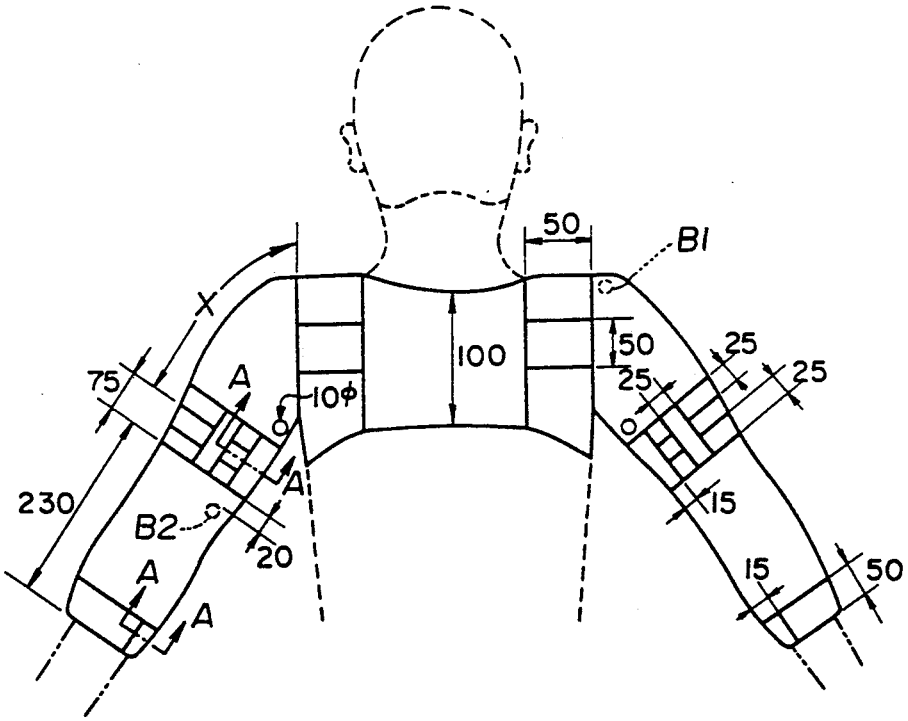
FIGS. 8A and 8B are views both showing an example of actually designed wear according to the first embodiment.
Figure 8B:
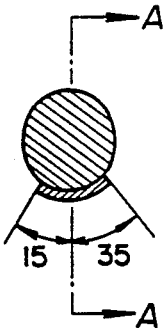

Incidentally, an example of an actually designed wear 101 and several measurements thereof are shown in FIGS. 8A and 8B. In FIG. 8A, a measurement shown by a numeral "X" is determined by a body shape of the player. In addition, B1 designates a position of a shoulder bone, and B2 designates a position of an elbow bone. Further, in a sectional view of FIG. 8B taken in a line A—A of FIG. 8A, the measurements of the plane fasteners 111*a* and 113*a* in a longitudinal direction are shown.

[B] Second Embodiment

Figure 9:
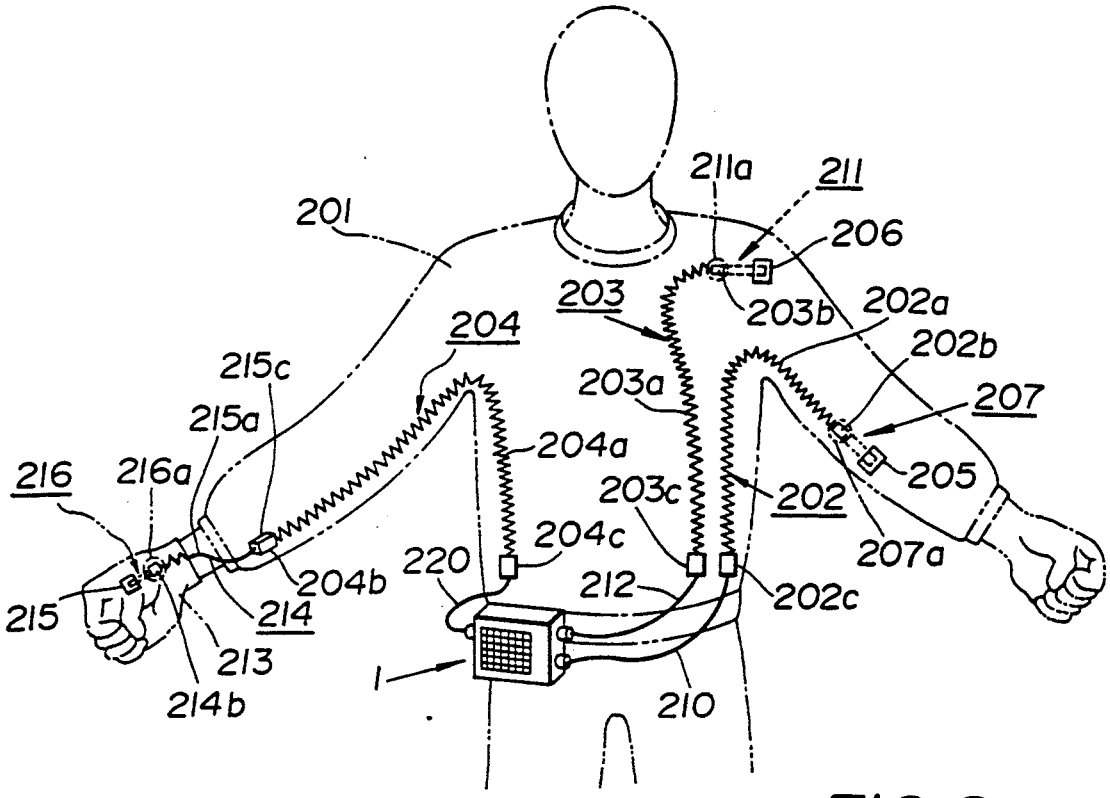
FIG. 9 shows an appearance of a player who wears a wear according to a second embodiment of the present invention.

FIG. 9 is a front view showing a player who wears a wear 201 according to the second embodiment of the present invention. As shown in FIG. 9, this wear 201 is formed so that this wear 201 can be worn by an upper half of the player's body, and this wear 201 is also made of elastic fiber materials. In such wear 201, one edge of a wiring member 202 is positioned at the left elbow portion of the wear 201, and another edge thereof is positioned at a left skirt portion of the wear 201. Similar to such wiring member 202, one edge of a wiring member 203 is positioned at a left shoulder blade portion of the wear 201, and another edge thereof is positioned at the left skirt portion of the wear 201. Similarly, one edge of a wiring member 204 is positioned at a right wrist portion of the wear 201, and another edge thereof is positioned at a right skirt portion of the wear 201.

Figure 10:
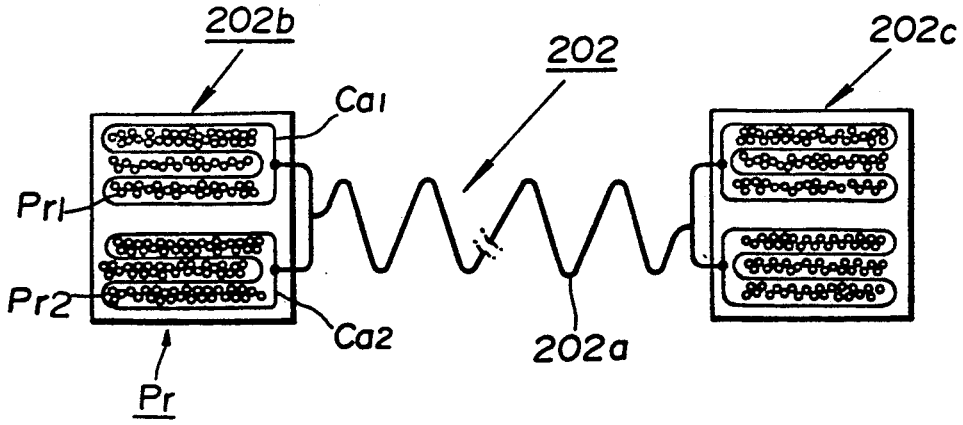
FIG. 10 is a plan view showing a detailed construction of a wiring member used in the second embodiment.

Next, description will be given with respect to each construction of the wiring members 202 to 204. First, the wiring member 202 is constructed as shown in FIG. 10. In FIG. 10, 202*a* designates a two-core cable which is sewed into the wear 201 in a zigzagging manner. One edge of this two-core cable 202*a* is connected with a connector 202*b*, and another edge thereof is connected with another connector 202*c*. These connectors 202*b* and 202*c* are sewed to the surface of the wear 201.

The connector 202*b* employs a square plate-shape plane fastener having a hook portion Pr. The center portion of this hook portion Pr is cut away so that a groove is formed thereon and the surface of the hook portion Pr is divided into right and left hook portions Pr1 and Pr2. In addition, a fine wire Ca1 is zigzagged, folded and then fixed at the hook portion Pr1. Similarly, a fine wire Ca2 is zigzagged, folded and then fixed at the hook portion Pr2. Each of these fine wires Ca1 and Ca2 is pressed against and then connected to each of two cores of the cable 202*a*. Further, conductive coating is painted on the hook portion Pr fixed with the fine wires Ca1 and Ca2. Furthermore, the connector 202*c* similar to the connector 202*b* is connected at another edge of the two-core cable 202*a*.

Figure 1A:
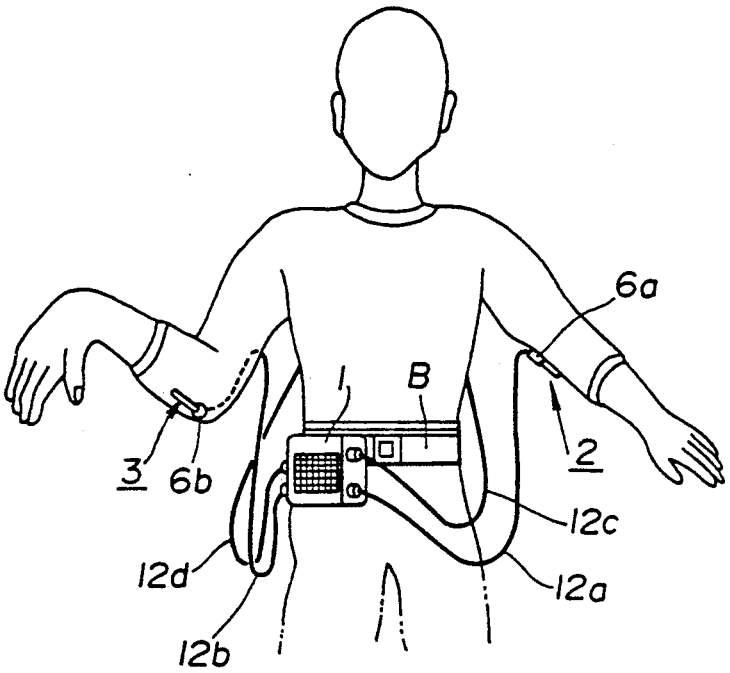
FIGS. 1A and 1B are front and back views both showing the musical tone control apparatus proposed by the present applicant.
Figure 1B:
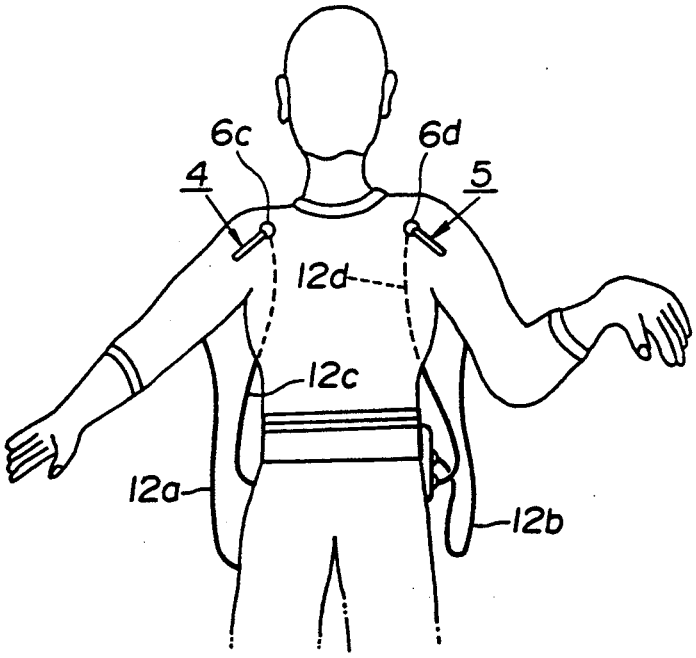
Figure 2:
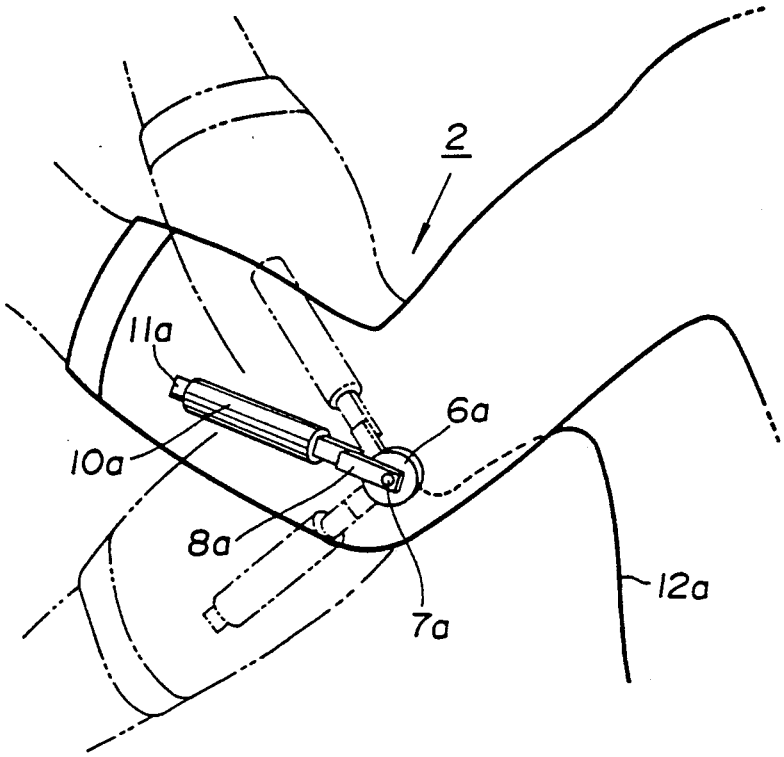
FIGS. 2 to 4 respectively show detailed constructions of the detectors used in the proposed musical tone control apparatus shown in FIGS. 1A and 1B.
Figure 3:
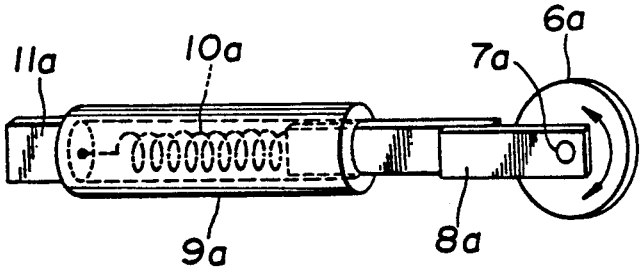
Figure 4:
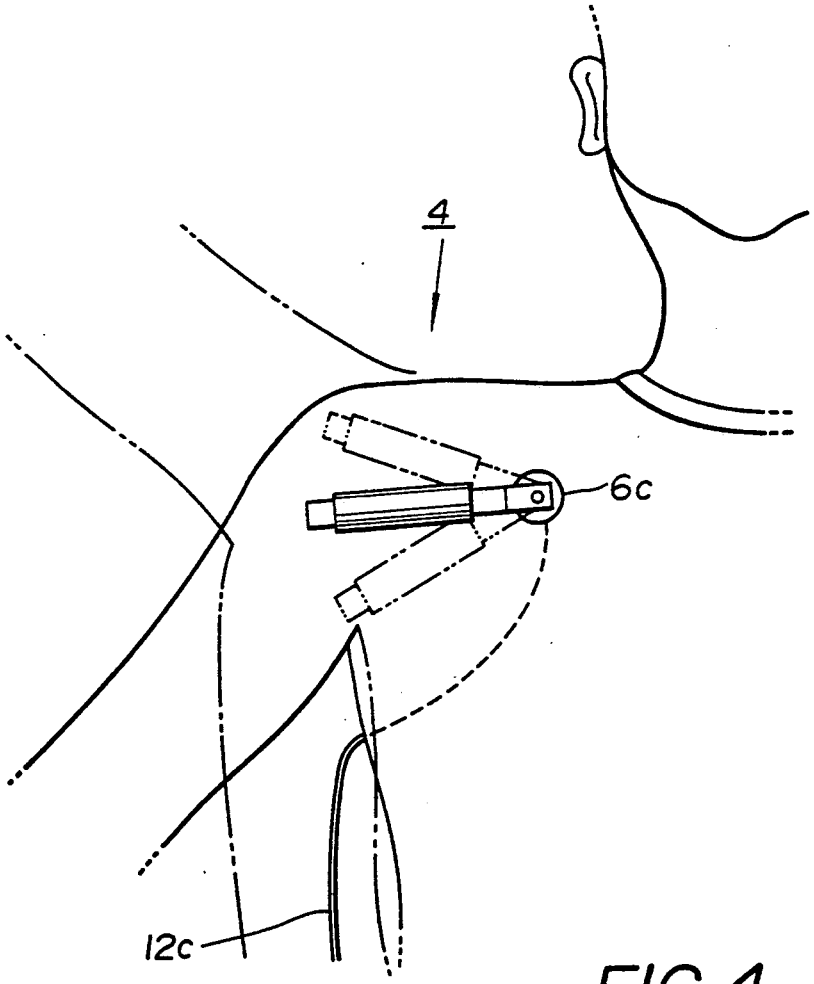
Figure 12:
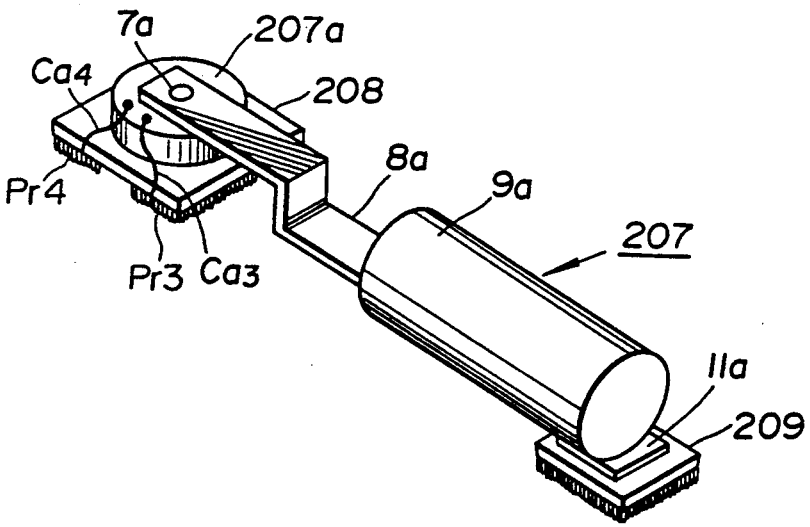
FIG. 12 is a perspective side view showing a detector used in the second embodiment.

In FIG. 9, a plane fastener 205 is sewed at a position which is apart the connector 202*b* by a predetermined distance. A detector 207 for the player's left elbow (similar to the detector 118 shown in FIG. 6) is mounted between the plane fastener 205 and the connector 202*b*. FIG. 12 shows a construction of this detector 207. In FIG. 12, a connector 208 is mounted at a bottom face of a potentiometer 207*a*. This connector 208 is constructed as similar to the connector 202*b* of the wiring member 202 shown in FIG. 10. In this connector 208, fine wires Ca3 and Ca4 are respectively fixed at hook portions Pr3 and Pr4, and these fine wires Ca3 and Ca4 are also connected to output terminals of the potentiometer 207*a*. In addition, a plane fastener 209 is mounted at a bottom face of the fixing portion 11*a* as shown in FIG. 3.

Figure 13:
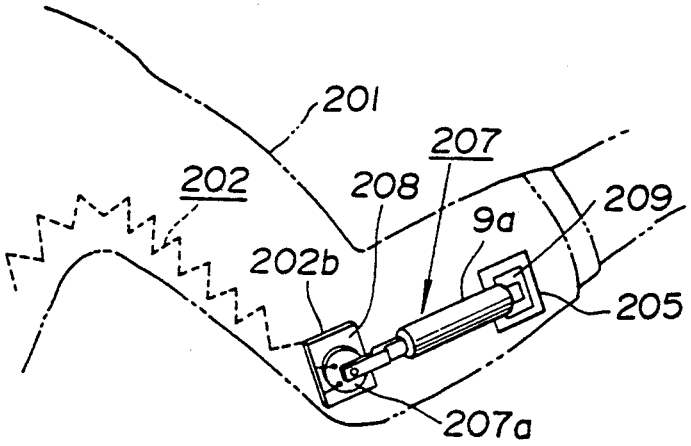
FIG. 13 shows an appearance of a detector for a player's left elbow mounted on the wear according to the second embodiment.

As shown in FIG. 13, the detector 207 can be mounted to the wear 201 by connecting the connector 208 to the connector 202*b* of the wear 201, and the output terminals of the potentiometer 207*a* can be connected to the wiring member 202. Thus, the potentiometer 207*a* is connected to the main body 1 via the cable 202*a*, the connector 202*c* and a cable 210 (shown in FIG. 9) connected to the connector 202*c*.

In FIG. 9, the wiring member 203 is constructed as similar to the wiring member 202. More specifically, a plane fastener 206 is sewed at a position which is apart from a terminal 203*b* of the wiring member 203 by a predetermined distance. A detector 211 for the player's left shoulder is constructed as similar to the detector 207 so that the detector 211 can detect a movement of the player's left shoulder joint. This detector 211 can be mounted between the terminal 203*b* of the wiring member 203 and the plane fastener 206. In this case, a potentiometer 211*a* of the detector 211 is connected to the main body 1 via a cable 203*a*, a connector 203*c* and a cable 212 connected to the cable 203*c*. Incidentally, each one edge of cables 210 and 212 is provided with a connector similar to the connector 202*b* of the wiring member 202.

Figure 11A:
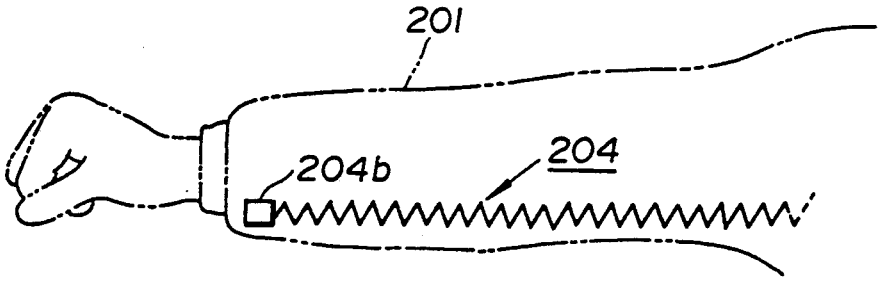
FIGS. 11A and 11B are side views each showing an arm portion provided with the wiring member of the wear according to the second embodiment.
Figure 11B:
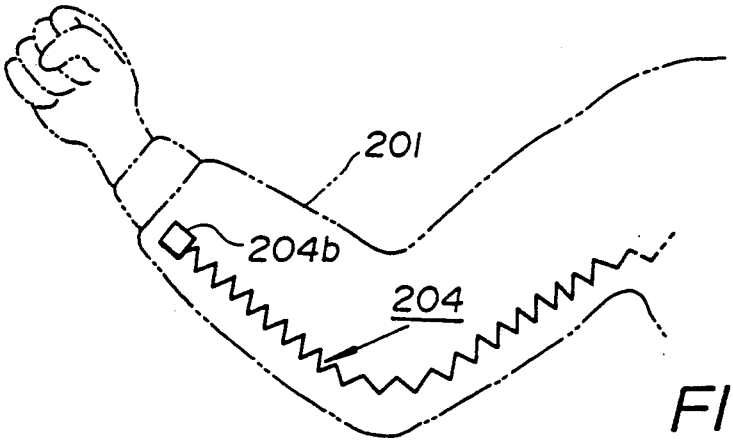
Figure 14:
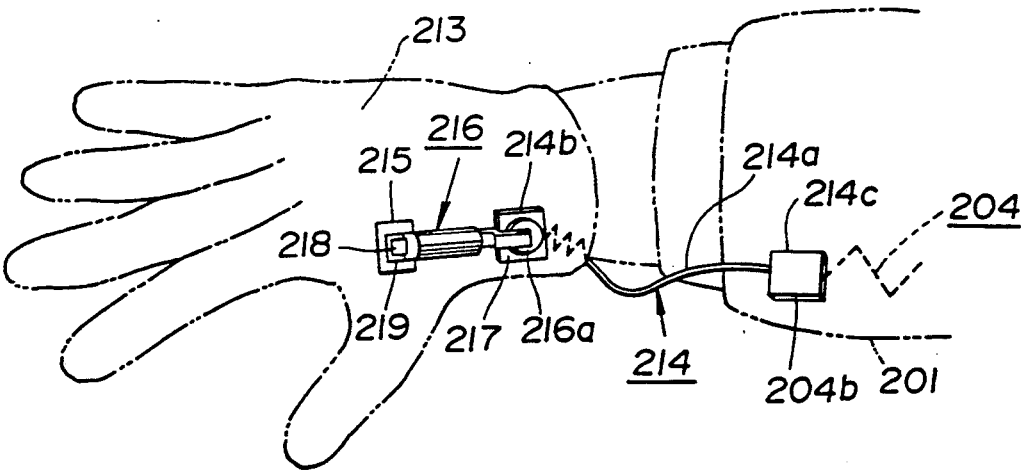
FIG. 14 shows an appearance of a detector for a player's wrist mounted on the wear according to the second embodiment.

Next, a glove 213 made of the elastic fiber materials is used for a player's right hand, and this glove 213 is constructed as shown in FIG. 14. In FIG. 14, one edge of a wiring member 214 is positioned at a wrist portion of the glove 213, and another edge thereof is positioned at a right sleeve portion of the wear 201. In this case, the wiring member 214 is zigzagged and then sewed into the glove 213. In addition, one edge of the wiring member 214 is connected to a connector 214*b* which is sewed to a surface of the glove 213, and another edge thereof is connected to a connector 214*c* which is also connected to the connector 204*b* of the wiring member 204. Further, a plane fastener 215 is sewed at a position which is apart from the connector 214*b* of the wiring member 214 by a predetermined distance in a thumb direction of the glove 213. Incidentally, the wiring member 204 is constructed as similar to the above-mentioned wiring member 202. As shown in FIGS. 11A and 11B, when the player stretches and bends his right arm, the state of the wiring member 204 is changed. Meanwhile, the connectors 214*b* and 214*c* are constructed as similar to the connectors 202*b* and 202*c* of the wiring member 202.

Next, a detector 216 for detecting a movement of the player's right wrist joint is constructed as similar to the detector 207, but a size of the detector 216 is smaller than that of the detector 207. In this detector 216, a connector 217 mounted on a bottom face of a potentiometer 216*a* is connected with the connector 214*b* of the wiring member 214, and a plane fastener 219 mounted on a bottom face of a fixing portion 218 is connected with the plane fastener 215 provided on the glove 213. As described above, the detector 216 is connected between the plane fastener 215 and the connector 214*b* of the wiring member 214 provided on the glove 213. Thus, the potentiometer 216*a* is connected to the main body 1 via the cable 204*a*, the connector 204*c* and a cable 220 (shown in FIG. 9) connected to the connector 204*c*. Incidentally, one edge of the cable 220 is connected to a connector similar to the connector 202*b* of the wiring member 202.

Figure 15:
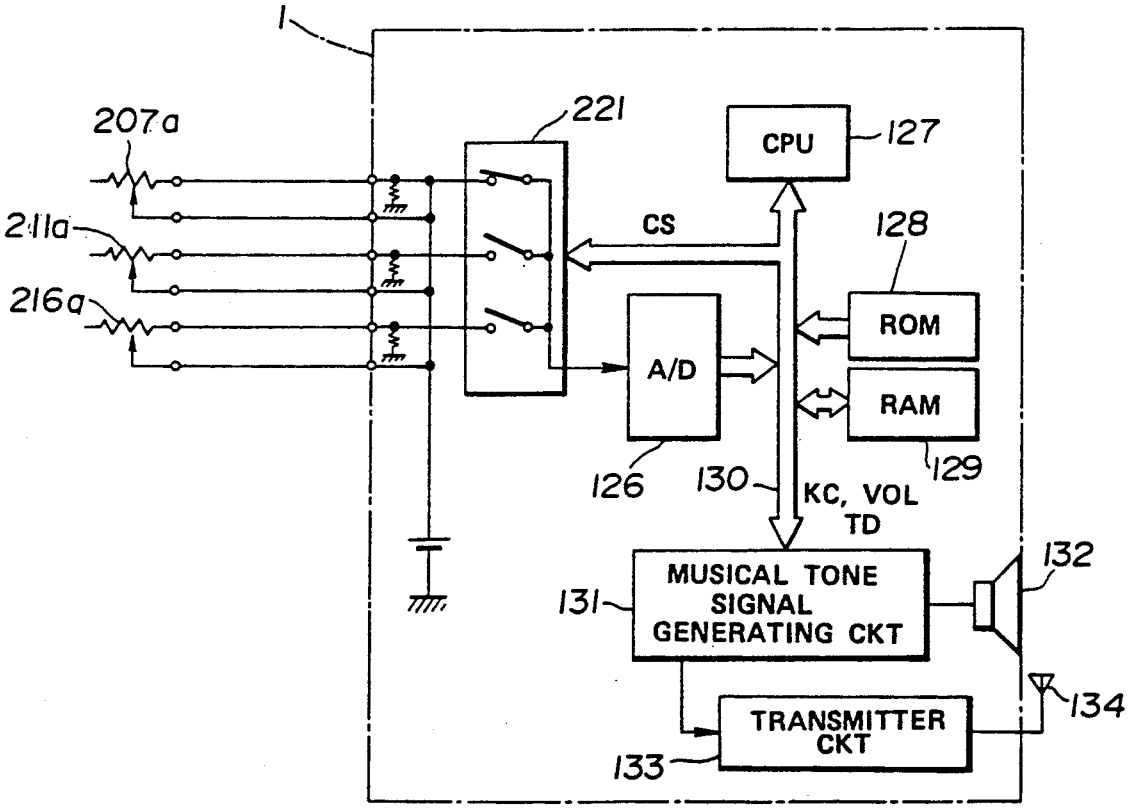
FIG. 15 is a block diagram showing an electric constitution of the second embodiment.

Next, FIG. 15 is a block diagram showing an electric constitution of the main body 1 according to the second embodiment. In FIG. 15, 221 designates a three-channel analog multiplexer which selects one of detection signals from the detectors 207, 211 and 216 based on the channel select signal CS outputted from the CPU 127. Other parts within the main body 1 are similar to those shown in FIG. 7, hence, description thereof will be skipped.

In the second embodiment, the key code data KC are generated based on detection data of the detector 207, and a tone pitch of the musical tone is controlled based on the bending angle of the player's left elbow. In addition, the tone volume data VOL are generated based on detection data of the detector 211, and a tone volume of the musical tone is controlled based on the bending angle of the player's left shoulder. Further, the tone color data TD are generated based on detection data of the detector 216, and a tone color of the musical tone is controlled based on the bending angle of the player's right wrist.

[C] Third Embodiment

Figure 16A:
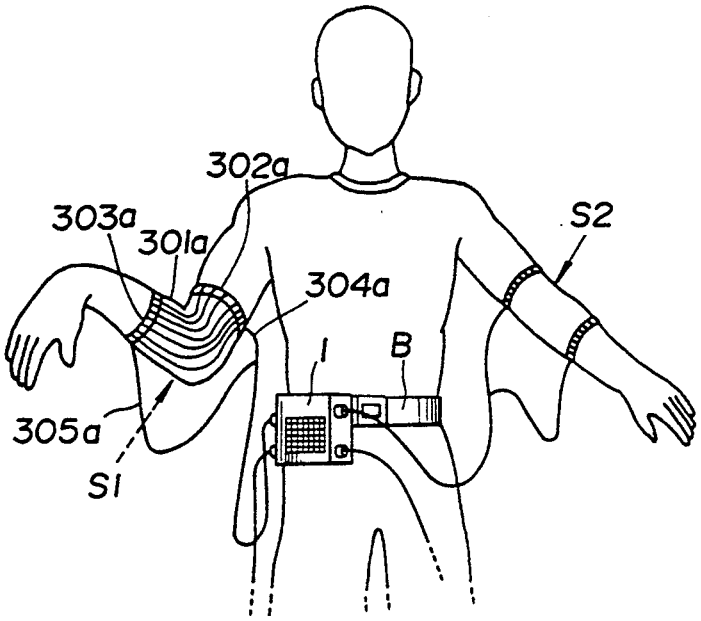
FIGS. 16A and 16B show appearances of a player who wears a wear according to the third embodiment.
Figure 16B:
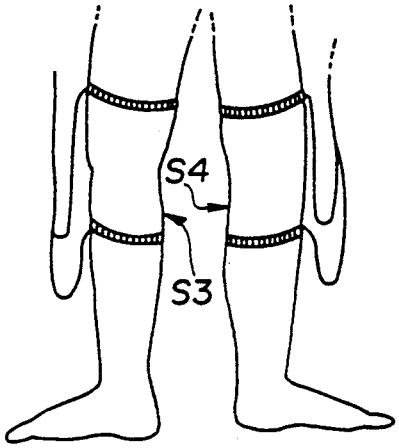
Figure 17:
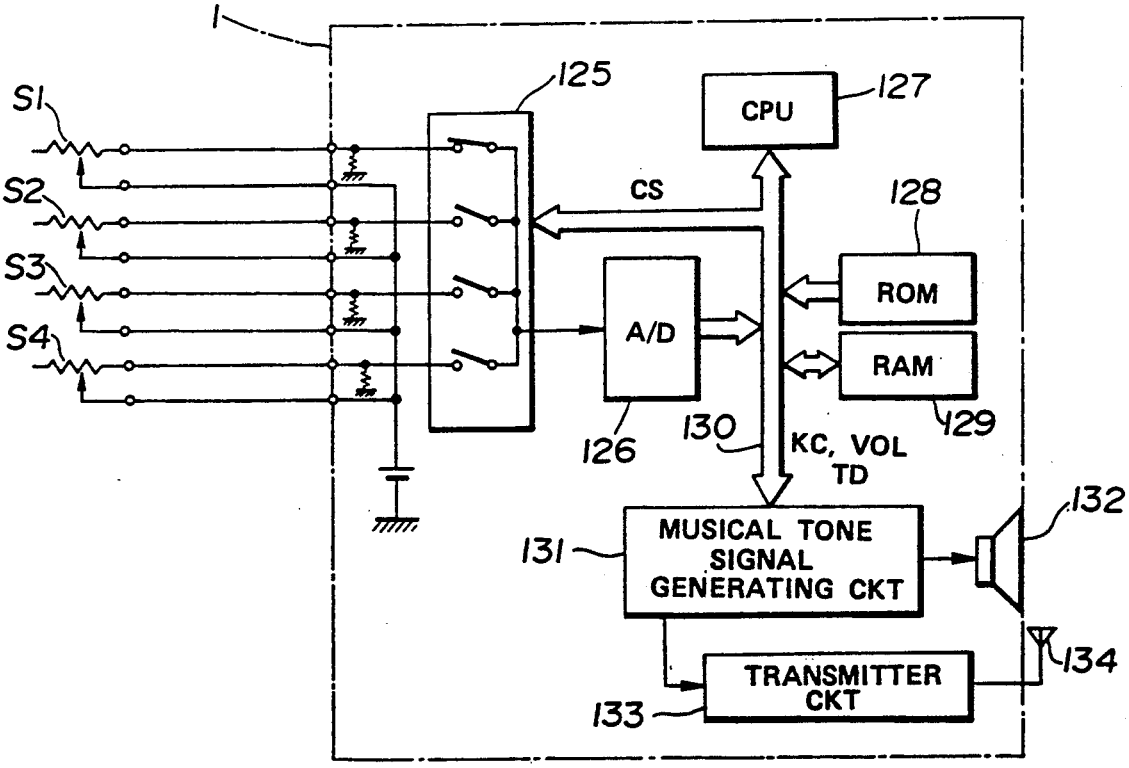
FIG. 17 is a block diagram showing an electric constitution of the third embodiment.

FIGS. 16A and 16B show appearances of a player who wears a wear according to the third embodiment of the present invention, and FIG. 17 is a block diagram showing the third embodiment. This wear according to the third embodiment consists of the main body 1, a detector S1 for the player's right elbow, a detector S2 for the player's left elbow, a detector S3 for a player's right knee and a detector S4 for a player's left knee. As described before, the main body 1 is mounted at the player's waist by the belt B. In addition, the detectors S1, S2, S3 and S4 are respectively mounted at the right elbow, the left elbow, the right knee and the left knee of the player.

Figure 18:
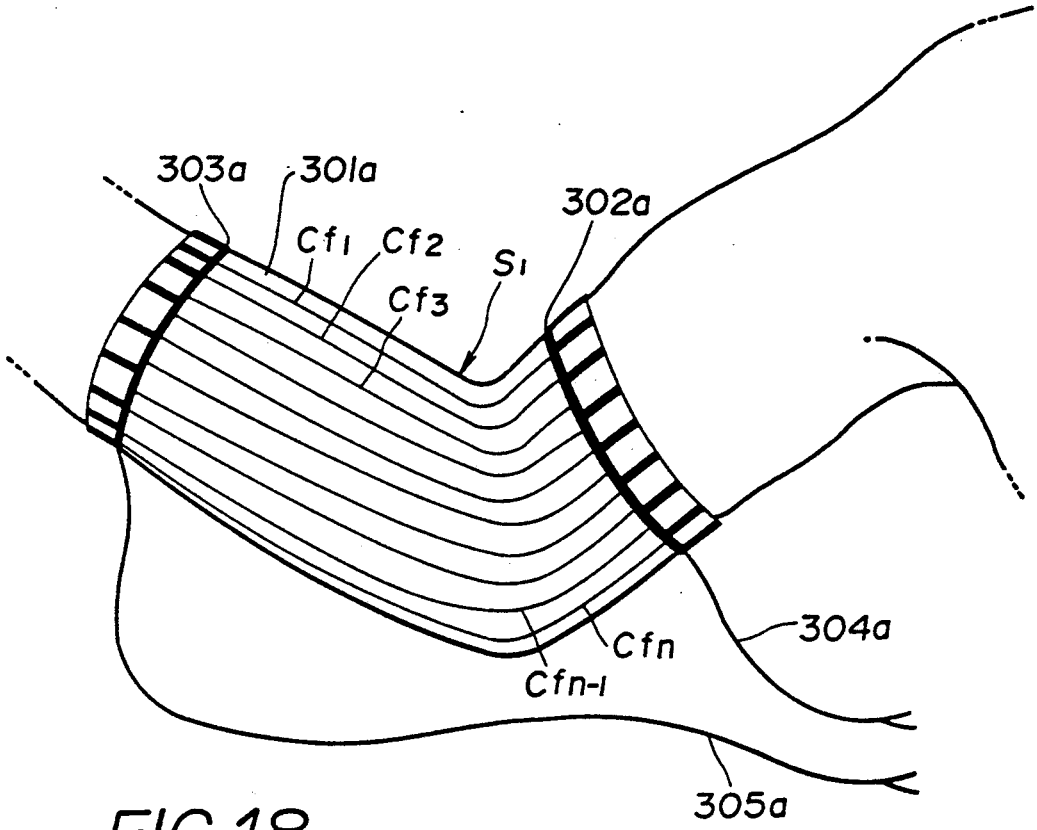
FIG. 18 is a perspective side view showing a detector worn by a player's elbow.

Next, description will be given with respect to the detectors S1 to S4. First, the detector S1 is constructed as shown in FIG. 18. In FIG. 18, 301*a* designates a supporter made of elastic and insulating fiber materials (such as rubber materials). The shape of this supporter 301*a* can be fitted to the shape of the player's right elbow. At outer peripheries of both edges of the supporter 301*a*, band-shape conductive members 302*a* and 303*a* are respectively attached. On outer peripheries of the supporter 301*a*, carbon fibers Cf1 to Cfn (where n denotes an integral number) are attached by predetermined intervals in a longitudinal direction of the supporter 301*a*. Each one edge of the carbon fibers Cf1 to Cfn is connected to the conductive member 302*a*, and each another edge of the carbon fibers Cf1 to Cfn is connected to the conductive member 303*a*.

Figure 19:
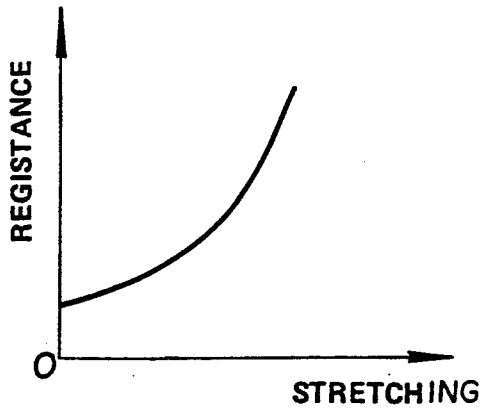
FIG. 19 is a graph showing a characteristic of a resistance of the detector shown in FIG. 18.

When the above-mentioned detector S1 is stretched in the longitudinal direction thereof, a resistance between the conductive members 302*a* and 303*a* is increased in accordance with the stretching of the detector S1 as shown in FIG. 19. In short, when the player mounts the detector S1 on his right elbow as shown in FIG. 18 and then stretches his right elbow, the resistance between the conductive members 302*a* and 303*a* must be varied in response to the bending angle of the player's right elbow.

Similar to the detector S1, other detectors S2, S3 and S4 are constructed. Detection signals outputted from the detectors S1 to S4 are respectively supplied to the four-channel analog multiplexer 125 within the main body 1 shown in FIG. 17. This main body 1 shown in FIG. 17 functions as similar to the main body 1 shown in FIG. 7, hence, description thereof will be skipped.

In the third embodiment, the tone pitch of the musical tone is controlled based on a combination of the bending angles of the player's right and left elbows, the tone volume of the musical tone is controlled based on the bending angle of the player's right knee, and the tone color of the musical tone is controlled based on the bending angle of the player's left knee.

Above is the description of the preferred embodiments of the present invention. This invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. An article of wear for controlling a musical tone, said article of wear having an inner surface and an other surface, comprising:

(a) at least one mounting member fixedly mounted to the other surface of said article of wear near a joint of a player; and (b) movement detecting means for detecting a movement of said joint, said movement detecting means being detachably mounted to said other surface of said article of wear by said fixed mounting member such that said movement detecting means avoids contact with the skin of said player, whereby said musical tone is controlled based on the detected movement of said joint.

2. An article of wear according to claim 1, wherein said movement detecting means comprises a potentiometer for detecting a bending angle of said joint.

3. An article of wear according to claim 1, wherein said mounting member is a flat fastener.

4. An article of wear according to claim 2, further comprising a main body which generates a musical toe, wherein at least one of a tone pitch, a tone volume and a tone color of said musical tone is controlled based on said bending angle of said joint detected by said potentiometer.

5. An article of wear according to claim 1, wherein said movement detecting means detects an angle of said joint.

6. An article of wear according to claim 1, wherein said movement detecting means detects the relative positions of first and second body members joined at said joint by detecting a distance between a first position of the first body member and a second position of the second body member.

7. An article of wear according to claim 1, wherein said movement detecting means detects the relative positions of body members joined at said joint by detecting a rotation of one of said body members about an associated axis.

8. An article of wear for controlling a musical tone, comprising:

(a) movement detecting means detachably mounted to said article of wear and having an output wire, for detecting a movement of said player and for delivering a detection signal representative of a detected movement, said musical tone being controlled based on said detection signal;

(b) a first terminal mounted at a first position of said article of wear and connected with an output wire of said movement detecting means;

(c) a second terminal mounted at a second position of said article of wear; and (d) a wire for connecting said first and second terminals, said wire being affixed to said article of wear at plural points along said wire such that said wire is prevented from being twisted about said player and caught on surrounding objects.

9. An article of wear according to claim 8, wherein said movement detecting means comprises a potentiometer for detecting a bending angle of a joint of a player.

10. An article of wear according to claim 9, further comprising a main body which generates a musical tone, wherein at least one of a tone pitch, a tone volume and a tone color of said musical tone is controlled based on said bending angle of said joint detected by said potentiometer.

11. An article of wear according to claim 8, wherein said wire is sewed onto said article of wear in a manner which permits said article of wear to expand and contract.

12. An article of wear for controlling a musical tone, comprising:

(a) a plurality of movement detecting means for detecting a movement of a player, each of said movement detecting means comprising fibers, the resistance of said fibers being varied in response to bending and stretching movement of said fibers, each of said movement detecting means being mounted at a joint of a player, whereby said resistance of said fibers is varied in response to a bending angle of said joint; and (b) control means for detecting resistance variations of said movement detecting means respectively corresponding to variations in the bending angles of said joints, said control means controlling said musical tone based on detected resistance variations of said movement detecting means, whereby said musical tone is controlled based on detected bending angles of said joints.

13. An article of wear according to claim 12, wherein said movement detecting means is a supporter having a conductive member at each edge thereof, said supporter also having carbon fibers between said conductive members at both edges thereof, whereby a resistance between said conductive members is varied in response to bending and stretching movements of said supporter.

14. An article of wear according to claim 13, wherein at least one of a tone pitch, a tone volume, and a tone color of said musical tone to be generated is varied based on the detected resistance variation of said supporter.

15. An article of wear for controlling a musical tone, comprising:

(a) at least one mounting member fixedly mounted near a joint of a player when said wear is worn by the player; and (b) movement detecting means for detecting a movement of said joint, said movement detecting means being detachably mounted to said article of wear by said fixed mounting member such that said movement detecting means bridges over said joint, whereby said musical tone is controlled based on a detected movement of said joint.

16. An article of wear according to claim 15, wherein a first end of said movement detecting means is positioned on one side of said joint and a second end of said movement detecting means is positioned on another side of said joint.

17. An article of wear according to claim 15, wherein said movement detecting means includes a rotatable member positioned on the article of wear so that the rotatable member of said movement detecting means rotates in correspondence with a movement of said joint and said movement detecting means detects a rotation of said rotatable member.

18. An article of wear according to claim 15, wherein said movement detecting means detects an angle of said joint.

19. An article of wear according to claim 15, wherein said movement detecting means detects the relative positions of body members joined at a joint by detecting a distance between a first portion of a body member and a second portion of a second body member.

20. An article of wear according to claim 15, wherein said movement detecting means detects the relative positions of body members joined at a joint by detecting a rotation of one of said body members about an associated axis.

21. A device for controlling a musical tone, comprising:

(a) an article of wear, said article of wear being adapted to be worn by a player;

(b) detecting means for detecting the angle of a joint of a player through a range of motion thereof, whereby said musical tone is controlled throughout the range of motion based on the detected angle of said joint; and (c) means, affixed to said wear, for mounting said detecting means to said article of wear so as to be freely removable from said article of wear.

* * * * *